US008356567B1

(12) United States Patent
Gaston et al.

(10) Patent No.: US 8,356,567 B1
(45) Date of Patent: Jan. 22, 2013

(54) ARRANGEMENT FOR FUELING A WATER VESSEL

(75) Inventors: Gregory V. Gaston, Chesapeake, VA (US); John T. Phillips, Virginia Beach, VA (US); Brandon R. Bagwell, Hampton, VA (US); Ronald K. Moser, Chesapeake, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 617 days.

(21) Appl. No.: 12/570,291

(22) Filed: Sep. 30, 2009

Related U.S. Application Data

(63) Continuation-in-part of application No. 12/079,063, filed on Mar. 3, 2008, now Pat. No. 8,020,505.

(60) Provisional application No. 61/268,656, filed on May 19, 2009.

(51) Int. Cl.
*B63B 21/56* (2006.01)
*B63B 21/58* (2006.01)

(52) U.S. Cl. ..... 114/242; 114/249; 114/250; 114/253

(58) Field of Classification Search ..... 114/242, 114/244, 245, 248–253, 258, 322
See application file for complete search history.

(56) References Cited

U.S. PATENT DOCUMENTS

| | | | | |
|---|---|---|---|---|
| 2,956,532 | A * | 10/1960 | James et al. | 114/254 |
| 2,963,179 | A * | 12/1960 | Woods et al. | 414/139.5 |
| 3,943,875 | A * | 3/1976 | Sanders | 114/244 |
| 4,066,093 | A | 1/1978 | Egerstrom | |
| 4,276,033 | A | 6/1981 | Krovina | |
| 5,139,751 | A | 8/1992 | Mansfield et al. | |
| 6,073,916 | A | 6/2000 | Plummer | |
| 6,883,453 | B1 * | 4/2005 | Mulhern | 114/253 |
| 7,025,014 | B1 * | 4/2006 | Forgach et al. | 114/244 |
| 7,156,036 | B2 * | 1/2007 | Seiple | 114/254 |
| 7,506,606 | B2 * | 3/2009 | Murphy et al. | 114/368 |
| 7,699,015 | B1 * | 4/2010 | Said | 114/253 |
| 8,020,505 | B1 * | 9/2011 | Galway | 114/249 |
| 8,225,735 | B1 * | 7/2012 | Galway | 114/242 |

OTHER PUBLICATIONS

Galway, Robert, "Autonomous Refueling of Unmanned Vehicles at Sea", Non-Patent Literature; May 19, 2008.

* cited by examiner

*Primary Examiner* — Ajay Vasudeva
(74) *Attorney, Agent, or Firm* — Dave A. Ghatt

(57) ABSTRACT

A method and apparatus for securing and fueling a surface water vessel at a floating station, attached to and remote from a parent ship. The surface water vessel may be an unmanned surface vehicle, for example. According to the invention, the surface water vessel includes a probe and the floating station includes an opening for receiving the probe therein. The floating station includes a fuel-delivering arrangement for feeding fuel from the parent ship to the water vessel.

14 Claims, 3 Drawing Sheets

ARRANGEMENT FOR FUELING A WATER VESSEL

CROSS-REFERENCE TO RELATED APPLICATIONS

This is application is a continuation-in-part of U.S. non-provisional patent application Ser. No. 12/079,063, now U.S. Pat. No. 8,020,505, hereby incorporated by reference, entitled, "Probe Receiver Device for Recovering Surface Water Vessels," filed Mar. 3, 2008.

This application claims the benefit of U.S. Provisional Application No. 61/268,656, filed May 19, 2009, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to an apparatus for fueling a surface water vessel, and in particular, an arrangement for latching and fueling a surface water vessel at a floating station that is remote from a parent ship.

BACKGROUND

The recovery of smaller surface water vessels, such as manned or unmanned surface water vessels (USVs), by larger parent ships is an emerging technology. Once recovered by the parent ship, servicing operations such as fueling may be performed. Typically, the recovery of a smaller vessel is accomplished by driving the smaller vessel alongside a stationary parent ship and lifted by davit into the ship. Alternatively, the smaller water vessel may be driven up a ramp into the larger ship.

Traditional methods of capturing smaller surface water vessels can cause damage to the hull of the smaller vessel. For example, some USVs weigh about 20,000 lbs and are made from materials such as aluminum. A capturing method that for example, requires the USV to be driven into a parent ship or be lifted and dropped onto the parent ship can cause damage to the aluminum hull, resulting in expensive repairs. The prior art does not teach a method and apparatus that captures the smaller vessel in a controlled manner away from the parent ship in order to perform servicing operations such as fueling.

SUMMARY

In one aspect, the invention is a fueling system for securing and fueling a water vessel at a floating station. The fueling system includes a parent ship having a fuel supply and a pump for delivering fuel from the fuel supply. The fueling system also includes a floating station remote from the parent ship. In this aspect, the floating station includes a tow opening, a fuel-delivering arrangement connected to the fuel supply of the parent ship. The fuel-delivering arrangement includes a hose, and a hose feeder for feeding the hose. The fueling system further includes a water vessel having a bow end and a stern end. The water vessel has a latching probe extending from the bow end, releasably latched within the tow opening of the floating station, and a fueling port for receiving fuel via the fuel-delivering arrangement.

BRIEF DESCRIPTION OF THE DRAWINGS

Other features will be apparent from the description, the drawings, and the claims.

DETAILED DESCRIPTION

Figure 1:
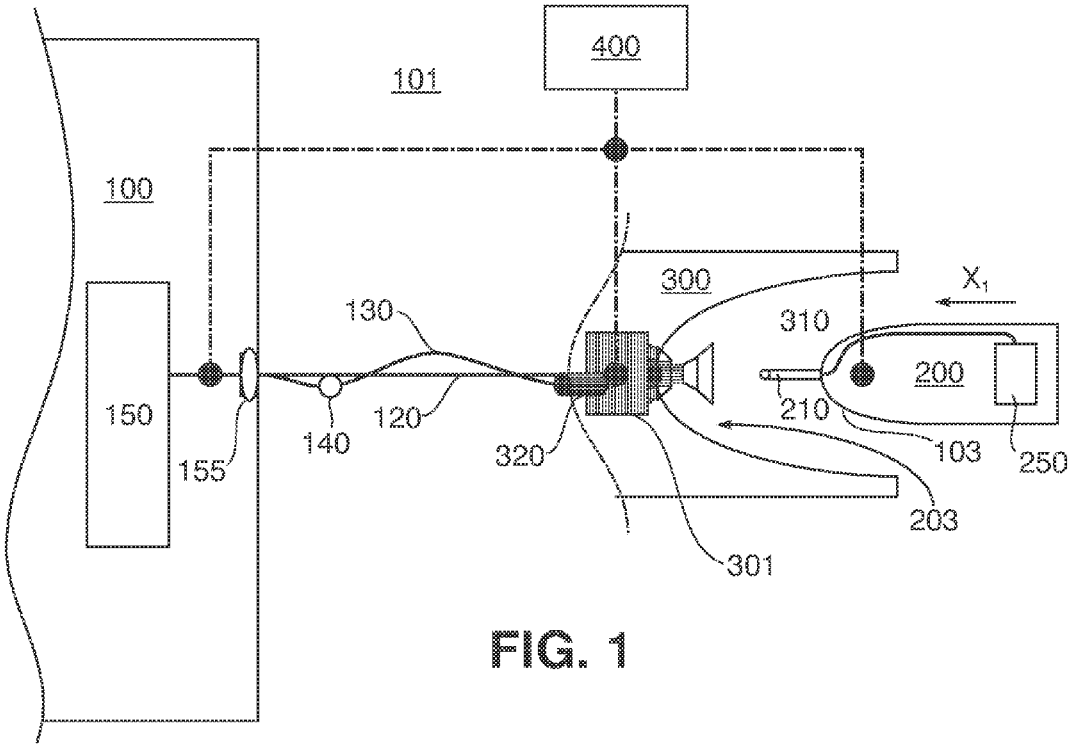
FIG. 1 is an exemplary schematic illustration of a fueling system for securing and fueling a water vessel at a floating station, according to an embodiment of the invention.

FIG. 1 is an exemplary schematic illustration of a fueling system 101 for securing and fueling a water vessel 200 at a floating station 300, according to an embodiment of the invention. The fueling system 101 is for the at sea fueling of a water vessel such as a manned or an unmanned surface vessel. The fueling system 101 also includes a parent ship 100 in addition to the floating station 300, with the floating station 300 being remote from the parent ship 100. The floating station 300 supplies fuel from the parent ship 100 to the water vessel 200, by means of a fuel-delivering arrangement 301, outlined below. The fueling system 101 also includes a control system 400 for controlling fueling operations.

FIG. 1 shows the floating station 300 having a substantially V-shaped receiving portion 203 for receiving and guiding the bow end of a water vessel 200 towards a latching arrangement 310. As will be outlined below, the latching arrangement 310 is for latching the water vessel 200 to the floating station 300 before commencing with servicing operations such as fueling. The latching arrangement 310 includes a tow opening 312 that receives a latching probe 210 that projects from the bow of the water vessel 200. As shown, the tow opening 312 may have a funnel shaped outer portion for guiding the probe 210 therewithin. The floating station 300 may be a solid structure or an inflated structure. The floating station 300 preferably has a weight and dimensions that allows it to ably support an attached water vessel 200. When the floating station 201 is an inflated structure, the body may be made from a material such as natural rubber, urethane rubber, fluororubber, silicone rubber, elastomers, plastics, and the like.

FIG. 1 shows the floating station 300 connected to the parent ship 100 by a tow line 120. FIG. 1 also shows a fuel conduit/line 130 such as a hose, running from the parent ship 100 to the fuel-delivering arrangement 301 of the floating station 300. The conduit 130 delivers the fuel from the parent ship 100 to the floating station 300, where vessels such as water vessel 200 are supplied with the fuel. The fuel on the parent ship 100 may be stored in a tank 150, to which the conduit 130 is connected. A pump 155, such as a centrifugal pump is also connected to the tank 150 and the conduit 130 for pumping fuel from the tank 150 to the floating station 300. In one embodiment, the pump may be a 1.5 HP high head centrifugal pump capable of supplying about 27 gallons per minute at about 65 psi. As shown, the fuel conduit 130 is equipped with one or more valves 140 for controlling the flow of fuel to the floating station 300. The valves 140 may lock off the flow of fuel in circumstances when the conduit 130 fails, thereby preventing undue spillage of fuel into the surrounding water. According to the invention, the water vessel 200 may be supplied with fuel only after the probe 210 is fully inserted and secured into the latching arrangement 310. FIG. 1A shows arrow $X_1$ indicating the direction in which the water vessel 200 travels with respect to the floating station 300, in order to be secured therewithin.

Figure 2A:
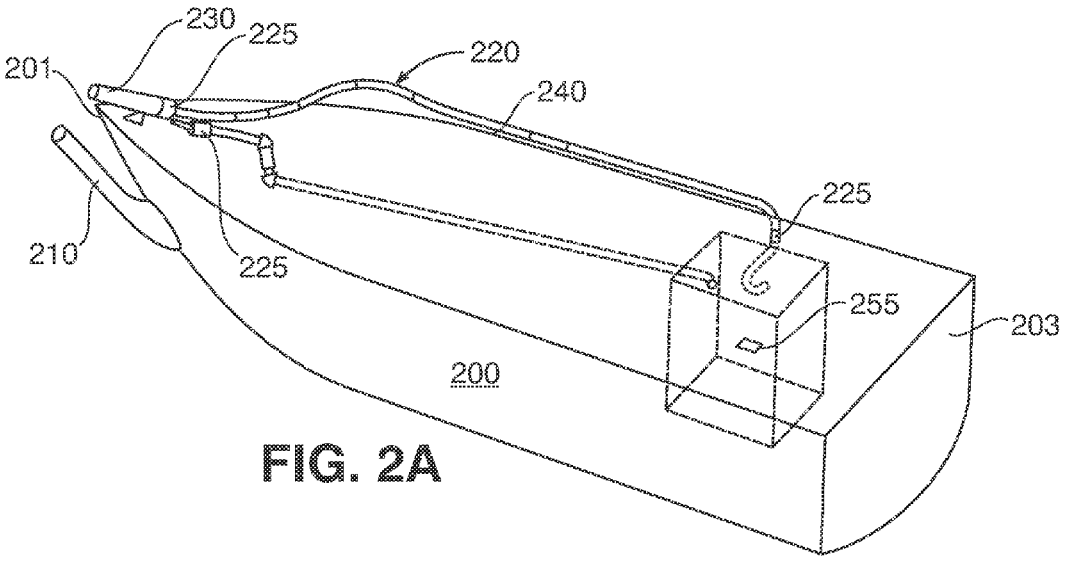
FIG. 2A is an exemplary schematic illustration of a water vessel, according to an embodiment of the invention.

FIG. 2A is an exemplary schematic illustration of a water vessel 200, according to an embodiment of the invention. As outlined above, the water vessel 200 may be used in the fueling system 101, and may be a manned or an unmanned surface vessel. As shown, the vessel 200 has a bow end 201 and a stern end 203. As stated above, the water vessel 200 includes a latching probe 210 projecting forwardly at the bow end 201. The latching probe 210, which may be pivotally attached at the bow end 201, is provided for insertion into the latching arrangement 310 of the floating station, for securing the water vessel 200 to the floating station 300. The latching arrangement 310 includes a sensor 315 (shown in FIG. 4) for detecting when the probe is properly latched. The operation of the probe 210 in relation to the latching arrangement 310 and associated sensor 315 as disclosed in U.S. patent application Ser. No. 12/079,063, now U.S. Pat. No. 8,020,505, entitled "Probe Receiver Device for Recovering Surface Water Vessels", which as stated above, is incorporated herein by reference for all that it discloses.

As shown in FIG. 2A, the water vessel 200 further includes a fueling port 220 for receiving fuel from the parent ship 100, via the floating station 300. The fueling port 220 includes a port probe 230 and a conduit relay 240. The port probe 230 is at the front end of the fueling port 220, and the conduit relay 240 is the elongated portion of the fueling port 220 that may extend the length of the water vessel 200 towards a fuel tank 250. The port probe 230 is hollow, and may be made from a double braided semi-rigid material, and the conduit relay 240 may be a metallic piping material such as aluminum or the like. Although the fuel tank 250 is illustrated towards the stern end 203 of the water vessel 200, the fuel tank 250 may be positioned at any desired location.

FIG. 2A shows the port probe 230 projecting forwardly over the bow end 201 of the water vessel 200. The port probe 230 is provided to establish a working engagement with the fuel-delivering arrangement 301 on the floating station 300. The semi-rigid/flexible probe 230 allows for relative motion between the water vessel 200 and the floating station 300. As will be outlined below, after a working engagement is established, the port probe 230 receives a fueling hose therethrough, which is fed through to the conduit relay 240 through to the fuel tank 250. FIG. 2A also shows one or more piping valves 225 along the conduit relay 240, the one or more piping valves sealing the conduit relay 240, and regulating when a fuel hose can be fed through the conduit relay 240 to the fuel tank 250. FIG. 2A shows the fueling port 220 being substantially external, and above the surface of the water vessel 200. Alternatively, the fueling port 220 may be substantially within the hull of the water vessel 200, as illustrated by the dotted lines, with the port probe 230 above the hull surface, and the alternative conduit relay 241 primarily within the hull.

The fuel tank 250 may include a fuel level sensor 255 for monitoring the level of fuel in the tank 250. Fueling operations may be controlled based on the level of fuel in the tank 250. A known liquid level sensor may be used in tank. For example, the sensor 255 may be a two-part sensor including a floating arm that floats at the surface of the fuel, and a stationary arm that is fixed. Electrical contacts associated with both parts may communicate resistance changes based on the relative distances between the floating arm and the stationary arm.

Figure 2B:
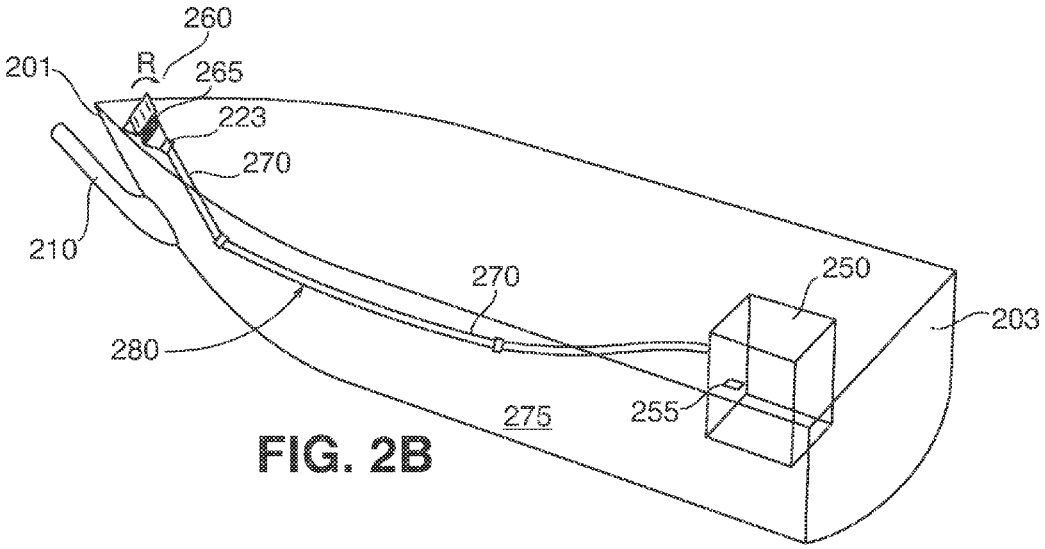
FIG. 2B is an exemplary schematic illustration of a water vessel, according to an embodiment of the invention.

FIG. 2B is an exemplary schematic illustration of a water vessel 275, according to an embodiment of the invention. The water vessel 275 is similar to that of water vessel 200, and may be used interchangeably with vessel 200 in the fueling system 100 illustrated in FIG. 1. Similar to water vessel 200, water vessel 275 has a hull having a bow end 201 and a stern end 203, and a latching probe 210 pivotally attached at the bow end 201. Water vessel 275 also includes a fueling port 280, the fueling port 280 having a receiver flap 260 and a connected conduit relay 270, which is an elongated portion of the fueling port 280 that may extend the length of the water vessel 275 towards a fuel tank 250. According to the embodiment of FIG. 2B, the receiver flap 260 is the only portion of the fueling port 280 that is exposed at or above the hull surface of the water vessel 275.

The receiver flap 260 is a pivotable flap, which lays flat along the hull surface when closed. A flap actuator 265 attached to the flap 260 moves the flap in direction R into a deployed position. In a deployed position the receiver flap 260 pivots upwards, revealing a rectangular funnel-like opening for receiving a fuel-feeding hose from fuel-delivering arrangement 301 on the floating station 300. As will be outlined below, the fuel-feeding hose is snaked down through the deployed flap through to the conduit relay 270 and into the tank 250, after the latching probe 210 is properly clamped within the latching arrangement 310 of the floating station 300. The fueling port 280 may also include one or more piping valves 225 along the conduit relay 270, the one or more piping valves 225 sealing the conduit relay 270, and regulating when a fuel hose can be fed through the conduit relay 270 to the fuel tank 250.

Figure 3:
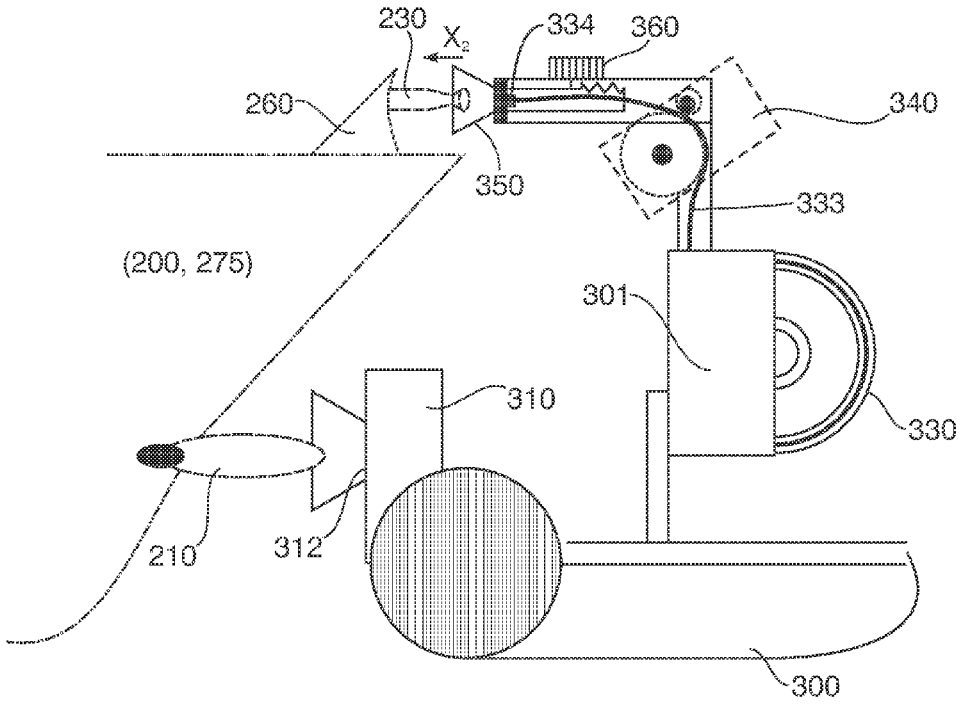
FIG. 3 is an exemplary schematic illustration of floating station including a fuel-delivering arrangement, according to an embodiment of the invention.

FIG. 3 is an exemplary sectional schematic illustration of floating station 300 including the fuel-delivering arrangement 301, according to an embodiment of the invention. In ghost dashed lines, FIG. 3 also illustrates how the various elements of the water vessels 200 and 275 interconnect with the floating station 300. FIG. 3 shows the latching arrangement 310, which includes the tow opening 312 that receives the latching probe 210 of the water vessel 200, as outlined above. The fuel-delivering arrangement 301 includes an inlet 320 (shown in FIG. 1) through which the fuel-delivering arrangement receives fuel that is fed from the parent ship 100 via a fuel conduit 130. The fuel-delivering arrangement 301 further includes a hose 333 through which fuel from the parent ship 100 is transported to the water vessel 200. The delivering arrangement also includes a hose reel 330 and a hose drive system 340, which combine to drive the hose 333 into the fueling port 220 of the water vessel 200. The hose reel 330 may be a constant tension device. The hose drive 340 may be a bidirectional drive, such as a 12V DC drive, capable of advancing and retracting the cable at about 0.3 ft/sec. The forward tip of the hose 333 may include a dispensing valve 334 to properly retain fuel within the hose 333 and to properly discharge fuel from the hose. The valve 334 may be a low-bias check valve, which may be opened when a predetermined supply pressure is applied. The dispensing valve 334 may also aid in the routing of the hose 333 as the hose 333 is fed through the fueling port 220.

The hose reel 330 may include a hose reel sensor 335 (shown in FIG. 4), for detecting when a predetermined length of the hose 333 has been dispensed. The predetermined length is the length of the hose 333 required to be unwound from the reel, in order for the hose 333 to properly snake through the fueling port 220 and into the tank 250 to allow for the safe and secure fueling of the water vessel 200. According to an embodiment of the invention, the predetermined length is about 18 m. The sensor 335 may be a ball clamp in combination with one or more electrical contacts. The ball clamp may be positioned so that when the predetermined length of hose 333 is dispensed, the ball clamp trips the one or more contacts, thereby producing the desired signal.

FIG. 3 also shows a funnel 350 for aligning the hose 333 with the fueling port 220 of the water vessel 200. A funnel actuator 360 as shown is used to drive the funnel 350 is movable in direction $X_2$ towards the probe 230. Because of the positioning of the funnel 350 on the floating station 300 in relation to the probe 230 of the water vessel 200, when the latching probe 210 is properly clamped within the latching arrangement 310, the funnel 350 is automatically vertically aligned with the probe 230. Thereafter, the funnel actuator 360 moves the funnel 350 to a forward-most position, so that the funnel 350 captures the port probe 230 therewithin. A funnel sensor 355 (shown in FIG. 4), such as a photo sensor, is located within the funnel, which based on changes in photo levels, light reflection readings, combinations thereof and the like, detects when the port probe is full captured within the funnel 350. When captured, a continuous hose-feeding channel is formed between the funnel and the hollow port probe 230.

In embodiments in which the water vessel 275 is employed, the funnel 350 is movable in directions $X_2$ towards the flap 260. Because of the positioning of the funnel 350 on the floating station 300 in relation to the deployed receiver flap 260 of the water vessel 275, when the latching probe 210 is properly clamped within the latching arrangement 310, the funnel 350 is automatically vertically aligned with the flap 260. Thereafter, the funnel actuator 360 moves the funnel 350 to a forward-most position, so that the funnel 350 is adjacent to the receiver flap 260. The funnel sensor 355, such as a photo sensor, may be used to detect when the funnel 350 is adjacent to the deployed receiver flap 260, thereby creating a continuous hose-feeding path. The continuous hose-feeding path allows the hose 333 to be fed from the funnel 350 of the fuel-delivering arrangement 301 through the deployed flap opening 260 of the water vessel 275. It should be noted that with the exception of the capturing of the probe 230 within the funnel 350, all aspects of the fueling operation between water vessel 200 and the floating station 300 are equally applicable to the fueling operations between the water vessel 275 and the floating station 300.

Figure 4:
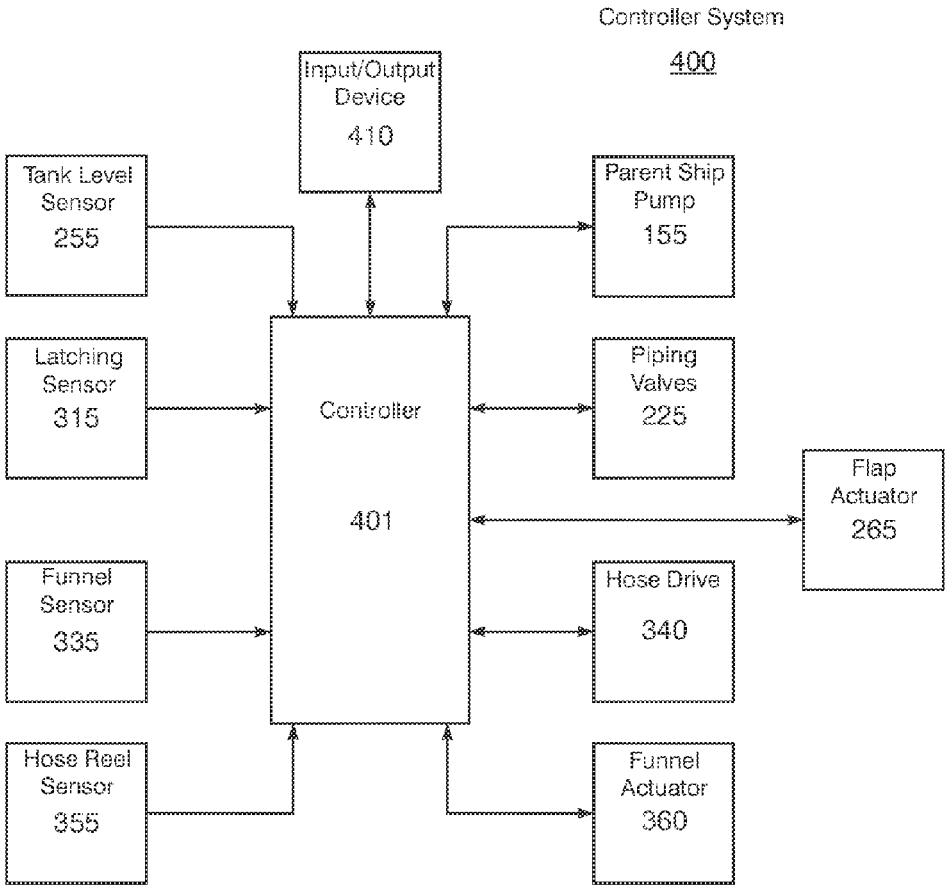
FIG. 4 is an exemplary schematic illustration of control system for controlling fueling operations, according to an embodiment of the invention.

FIG. 4 is an exemplary schematic illustration of control system 400 for controlling fueling operations, according to an embodiment of the invention. The control system includes a controller 401, which is preferably wireless. The controller 401 executes a control program to read inputs from sensors throughout the system 100, and based on the values of those inputs and control logic of the control program, produces outputs to actuators to control the fueling operations. As shown in FIG. 4, the controller 401 is connected to tank level sensor 255, the latching sensor 315, the funnel sensor 335, and hose reel sensor 355. In addition to the sensors, the controller 401 is operatively connected to a user input/output device 410 such as a touchpad or keypad, in which a user may input command signals and also monitor the operation of the control system 400. FIG. 4 also shows the controller 401 operatively attached to the parent ship pump 155, the one or more piping valves 225, the flap actuator 265, the hose drive 340, and the funnel actuator 360. The controller 401 may also be connected to other sensors and actuators throughout the system 100.

The operation of the system 101 is hereby outlined. As shown in FIG. 1, the fueling system 100 includes a parent ship 100, a floating station 300 that is remote from the parent ship 100, and a water vessel 200. As noted above, water vessel 275 may be alternatively used in the system 101. The floating station 300 receives fuel from the parent ship 100 via the conduit 130. This fuel may be delivered to the water vessel (200, 275) through the hose 333 located at the floating station. In operation, the water vessel (200, 275) approaches the floating station 300 in the direction $X_1$ to be latched therein, where servicing operations, such as fueling may commence. The water vessel (200, 275) is latched to the floating station 300 when the probe 210 at the hull of the vessel is fully inserted into the tow opening 312 of the latching device 310, and properly clamped within the latching arrangement 310. The latching of the probe 210 within the latching device 310 serves to vertically align the funnel 350 with either the probe 230 (of vessel 200) or the deployed receiver flap 260 (of vessel 275). Alternatively, the funnel may be vertically adjustable, if desired.

The latch sensor 315 detects the proper latching of the probe 210 in the latching device 310, and transmits a signal to the controller 401 indicating that the water vessel (200, 275) is properly secured to the floating station. The sensor 315 may be a movable mechanical arm or poppet that is pushed in a predetermined direction only when the probe 210 is securely clamped in the latching arrangement. If fueling is desired, a user may input a "fuel" command signal via the input device 410 initiating the fueling process. The user may enter this command before or after the water vessel (200, 275) has been secured at the floating station. However, fueling would only be initiated after the controller 401 receives a signal indicating that the vessel is properly secured.

In response to the user input and the signal from sensor 315, the controller initiates the funnel actuator 360 which moves the funnel 350 in the direction $X_2$ to an extended position. In the embodiment in which water vessel 200 is employed, as the funnel moves in direction $X_2$, the funnel 350 captures the hollow port probe 230 within, as shown in FIG. 3. As stated above, the funnel sensor 355, which may be a photosensor, detects when the hollow port probe 230 is fully captured within the funnel 350. When the hollow port probe 230 is fully captured, a continuous hose passage is formed between the funnel 350 and the fueling port 220, allowing for the smooth feeding of the hose 333 from fuel-delivering arrangement 301 to the water vessel 200. In response to a "fully captured" signal by the funnel sensor 355, the controller 401 initiates the hose drive 340 which then feeds the hose 333 from around the hose reel 320 through the funnel 350 into the fueling port 220, i.e., through the hollow port probe 230 and the conduit relay 240, into the fuel tank 250 of the water vessel 200.

Alternatively, in the embodiment in which water vessel 275 is employed, when fueling is initiated, the funnel 350 moves in direction $X_2$, towards the receiver flap 260 of the vessel 275; to position the funnel 350 adjacent to the receiver flap 260. Before the funnel 350 is moved to the forward in direction $X_2$, the receiver flap 260 may be pivoted to the deployed position in response to either the controller 401 or the user input via device 410. The funnel sensor 355, which may be a photosensor, detects when the funnel 350 is positioned adjacent to the deployed receiver flap 260, thereby creating a continuous hose path formed between the funnel 350 and the flap 260, allowing for the smooth feeding of the hose 333 from fuel-delivering arrangement 301 to the water vessel 275. When the funnel sensor 355 signals that funnel 350 has attained a working position adjacent to the flap 260, the controller 401 initiates the hose drive 340 which then feeds the hose 333 from around the hose reel 320 through the funnel 350 into the fueling port 280 and into the fuel tank 250 of the water vessel 200.

In all system embodiments, i.e., employing either water vessel 200 or water vessel 275, the hose 333 is fed only to a predetermined length, i.e., a length that enables the hose 333 to reach the fuel tank 250 and to properly fill the tank with the fuel. As stated above, the hose reel 330 includes a hose reel sensor 335, which may be a ball clamp in combination with one or more electrical contacts. The ball clamp may be positioned so that when the predetermined length of hose 333 is dispensed, the ball clamp trips the one or more contacts, thereby producing the desired signal terminating the feeding of the hose 333. As shown in FIGS. 2A and 2B, water vessels 200 and 275 may each include one or more piping valves 225. Thus, when piping valves are included, the controller opens these one or more valves to allow the hose 333 into the respective fueling ports.

In response to the termination of the feeding of the hose 333, the controller 401 actuates the pump 155 on the parent ship 100. As stated above, the pump 155 may be a 1.5 HP high head centrifugal pump capable of supplying about 27 gallons per minute at about 65 psi. The pump begins pumping fuel from the parent ship tank 150 to the floating station 300, which is received by the fuel-delivering arrangement 301. The fuel is then fed through the hose 333 to the fuel tank 250 in water vessel (200, 275). As stated above, the hose 333 may include a delivery valve that opens at a predetermined supply pressure of about 5 psi.

The fuel level sensor 255 detects when the fuel level in the tank 250 reaches a "full" level, and transmits to the controller 401 a signal indicating that the tank 250 is full. In response to this signal, the controller 401 cuts off the pump and terminates the delivery of fuel. Additionally, the controller 401 actuates the hose drive 340, which reverses rotation direction and pulls the hose 333 from the fueling port (220, 280). The hose is thus rewound about the hose reel 330. This ends the fueling operation, after which the water vessel (200, 275) may be retained for towing or for further servicing operations, or the alternatively, the water vessel (200, 275) may be released by unlatching and withdrawing the probe 210 from the latching device 310.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A fueling system for securing and fueling a water vessel at a floating station, the fueling system comprising:

a parent ship having a fuel supply and a pump for delivering fuel from the fuel supply;

a floating station remote from the parent ship, the floating station comprising:

a tow opening;

a fuel-delivering arrangement connected to the fuel supply of the parent ship, the fuel-delivering arrangement comprising:

a hose; and a hose feeder for feeding the hose, wherein the hose feeder comprises:

a movable funnel forwardly movable to create a continuous hose-feeding path from the fuel-delivering arrangement;

a funnel actuator for moving the funnel;

a rotatable reel carrying the hose; and a bidirectional driving arrangement for driving the hose from around the rotatable reel;

a water vessel having a bow end and a stern end comprising:

a latching probe extending from the bow end, and releasably latched within the tow opening of the floating station; and a fueling port for receiving fuel via the fuel-delivering arrangement.

2. The fueling system of claim 1, wherein the fueling port comprises:

a hollow port probe projecting forwardly at the bow of the water vessel;

a conduit relay extending from the port probe at the bow end of the water vessel; and wherein the water vessel further comprises a fuel collection device, wherein the conduit relay extends into the fuel collection device.

3. The fueling system of claim 2, wherein the movable funnel is configured to capture the hollow port probe therewithin, thereby creating the continuous hose passage from the fuel-delivering arrangement to the water vessel; and the funnel actuator is configured for moving the funnel forward to a position to capture the hollow port probe.

4. The fueling system of claim 3, wherein the bidirectional driving arrangement is configured for driving the hose from around the reel through the movable funnel into the hollow port probe and the conduit relay and the fuel collection device.

5. The fueling system of claim 4, further comprising:

a first sensor within the tow opening detecting when the latching probe is latched within the tow opening of the floating station;

a user input/output device allowing a user to input a command to initiate fueling, and a system controller operationally attached to each of the pump, the bidirectional driving arrangement, the funnel actuator, the first sensor, and the user input/output device, wherein in response to user-initiated fueling command and in response to the first sensor sending a signal indicating that the latching probe is latched with the tow opening of the floating station, the system controller powers the funnel actuator thereby moving the funnel forward to capture the hollow port probe therewithin.

6. The fueling system of claim 5, further comprising:

a second sensor within the funnel, detecting when the funnel fully captures the hollow port probe thereby creating the continuous hose passage from the fuel-delivering arrangement to the water vessel, wherein the second sensor is operationally attached to the system controller, wherein in response to the second sensor sending a signal indicating a fully captured hollow port probe with the funnel, the system controller initiates the bidirectional driving arrangement, to feed the hose from around the reel through the continuous hose passage continuous hose-feeding path between the fuel-delivering arrangement and the water vessel.

7. The fueling system of claim 6, further comprising:

a third sensor for terminating the feeding of the hose by shutting off the bidirectional driving arrangement, wherein in response to the termination of feeding of the hose, the system controller actuates the pump to deliver fuel from the parent ship to the water vessel via the fuel-delivering arrangement.

8. The fueling system of claim 7, further comprising:

a fourth sensor within the fuel collection device for detecting when fuel in the fuel collection device reaches a maximum level, the fourth sensor operationally connected to the system controller, wherein in response to the fourth sensor signaling that the fuel has reached said maximum level, the system controller terminates pumping and retracts the hose from the fueling port.

9. The fueling system of claim 1, wherein the fueling port comprises:

a pivotable receiving flap at the bow end of the water vessel, pivotable between a position flat along a hull surface when closed, and an open deployed position revealing a funnel-like opening for receiving the hose; and a conduit relay extending from the receiving flap at the bow end of the water vessel, wherein the water vessel further comprises a fuel collection device, wherein the conduit extends into the fuel collection device.

10. The fueling system of claim 9, wherein the movable funnel is movable to a position adjacent to the receiving flap to create the continuous hose-feeding path between the fuel-delivering arrangement and the water vessel;

the funnel actuator is configured for moving the funnel into the adjacent position; and the bidirectional driving arrangement is configured for driving the hose from around the reel through the funnel-like opening and the deployed receiver flap, and into the conduit relay and the fuel collection device.

11. The fueling system of claim 10, further comprising:

a first sensor within the tow opening detecting when the latching probe is latched within the tow opening of the floating station;

a user input/output device allowing a user to input a command to initiate fueling, and a system controller operationally attached to each of the pump, the bidirectional driving arrangement, the funnel actuator, the first sensor, and the user input/output device, wherein in response to user-initiated fueling command and in response to the first sensor sending a signal indicating that the latching probe is latched with the tow opening of the floating station, the system controller powers the funnel actuator thereby moving the funnel into the adjacent position with respect to the deployed receiving flap.

12. The fueling system of claim 11, further comprising:

a second sensor within the funnel, detecting when the funnel is adjacent to the deployed receiving flap thereby creating the continuous hose-feeding path between the fuel-delivering arrangement and the water vessel, wherein the second sensor is operationally attached to the system controller, wherein in response to the second sensor sending a signal indicating that the funnel is adjacent to the receiving flap, the system controller initiates the bidirectional driving arrangement, thereby feeding the hose from around the reel through the continuous hose-feeding path formed between the fuel-delivering arrangement and the water vessel, and into the conduit relay and fuel collection device of the water vessel.

13. The fueling system of claim 12, further comprising:

a third sensor for terminating the feeding of the hose by shutting off the bidirectional driving arrangement, wherein in response to the termination of feeding of the hose, the system controller actuates the pump to deliver fuel from the parent ship to the water vessel via the fuel-delivering arrangement.

14. The fueling system of claim 13, further comprising:

a fourth sensor within the fuel collection device for detecting when fuel in the fuel collection device reaches a maximum level, the fourth sensor operationally connected to the system controller, wherein in response to the fourth sensor signaling that the fuel has reached said maximum level, the system controller terminates pumping and retracts the hose from the fueling port.

* * * * *